US008256409B2

(12) United States Patent
Matsubayashi et al.

(10) Patent No.: US 8,256,409 B2
(45) Date of Patent: Sep. 4, 2012

(54) HEATING COOKER

(75) Inventors: Kazuyuki Matsubayashi, Osaka (JP); Hiroshi Hirano, Yao (JP); Hideo Shimoda, Nara-ken (JP)

(73) Assignee: Sharp Kabushiki Kaisha, Osaka (JP)

( * ) Notice: Subject to any disclaimer, the term of this patent is extended or adjusted under 35 U.S.C. 154(b) by 619 days.

(21) Appl. No.: 12/300,588

(22) PCT Filed: May 23, 2007

(86) PCT No.: PCT/JP2007/060514

§ 371 (c)(1),
(2), (4) Date: Nov. 12, 2008

(87) PCT Pub. No.: WO2007/138953

PCT Pub. Date: Dec. 6, 2007

(65) Prior Publication Data

US 2009/0205625 A1 Aug. 20, 2009

(30) Foreign Application Priority Data

May 25, 2006 (JP) ..... 2006-145260

(51) Int. Cl.
*F24C 15/32* (2006.01)
*A21B 1/08* (2006.01)
*A21B 1/00* (2006.01)

(52) U.S. Cl. ..... 126/21 A; 126/20; 126/369; 219/400; 219/401; 219/405

(58) Field of Classification Search ..... 126/20, 126/21 A, 369; 219/400, 401, 405
See application file for complete search history.

(56) References Cited

U.S. PATENT DOCUMENTS 3,759,241 A * 9/1973 Berkhoudt ..... 126/21 A
2007/0163567 A1 7/2007 Kaneko et al.

FOREIGN PATENT DOCUMENTS

| | | | |
|---|---|---|---|
| JP | 55-17023 | A | 2/1980 |
| JP | 1-139933 | A | 6/1989 |
| JP | 2000-257864 | A | 9/2000 |
| JP | 2005-195255 | A | 7/2005 |
| JP | 2005-344967 | A | 12/2005 |

* cited by examiner

*Primary Examiner* — Kenneth Rinehart
*Assistant Examiner* — William Corboy
(74) *Attorney, Agent, or Firm* — Birch, Stewart, Kolasch & Birch, LLP

(57) ABSTRACT

A protruding portion 100 having a sloped surface 100*b* sloped against a ceiling surface is provided on the ceiling side of a cooking chamber 20. Superheated steam from a steam temperature-raising device 50 is blown off from first ceiling steam blowoff openings 101 provided in a flat surface 100*a* of the protruding portion 100 toward a bottom face within the cooking chamber 20, while the superheated steam is blown off from second ceiling steam blowoff openings 102 provided in a sloped surface 100*b* of the protruding portion 100 toward the side face within the cooking chamber 20. The superheated steam blown off from these steam blowoff openings 101 and 102 is effectively supplied to upper-and-back surface of a heating object 90 rested in the cooking chamber 20 so as to be spaced from the bottom face of the cooking chamber 20.

5 Claims, 7 Drawing Sheets

HEATING COOKER

TECHNICAL FIELD

The present invention relates to heating cookers and to a heating cooker for heating a heating object, which is to be heated, with hot air or superheated steam.

BACKGROUND ART

Among conventional heating cookers is one which blows out steam through a ceiling surface and left-and-right side faces of a cooking chamber in order to achieve a cooking free from heating unevenness (see, e.g., JP 2005-344967 A). This heating cooker includes a steam temperature-raising device placed on an upper surface of the cooking chamber so that steam derived from the steam temperature-raising device is supplied to the cooking chamber via a ceiling steam outlet while the steam from the steam temperature-raising device is supplied from the left-and-right side-face outlets via steam supply passages.

However, the heating cooker has a problem that the steam supply passages from the steam temperature-raising device to the side-face outlets, which are bent from ceiling surface to side face side, are complex in structure and higher in parts cost, as well as longer in assembling time, leading to increases in its manufacturing cost.

DISCLOSURE OF THE INVENTION

Accordingly, an object of the present invention is to provide a heating cooker which allows a heating medium to be effectively supplied to the cooking chamber with a simple construction and moreover which allows reduction in parts count, facilitation of assembly and reduction of manufacturing cost to be achieved.

In order to achieve the above object there is provided a heating cooker for heating a heating object, which is accommodated in a cooking chamber and to be heated, by a heating medium obtained by a heating medium supply section, wherein the heating object is rested in the cooking chamber so as to be spaced from a bottom face of the cooking chamber, the heating medium has at least a first heating medium component in a first direction and a second heating medium component in a second direction which are blown off in different directions from blowoff openings of the heating medium supply section provided in a single inner wall surface out of inner wall surfaces of the cooking chamber, the heating medium component in the first direction is blown toward a first surface of the heating object, and the heating medium component in the second direction is blown toward the second surface of the heating object, which is a back side of the first surface.

It should be noted that in the present invention, a state of steam that is heated up to a 100° C. or higher superheated state is referred to as superheated steam, and high-temperature air obtained by simply heating air as with conventional microwave ovens refers to hot air.

Also, it should be noted that in the present invention, a concept including the superheated steam and hot air is referred to as heating medium.

According to the heating cooker constructed as described above, for heating of a heating object which is accommodated in the cooking chamber so as to be spaced from the bottom face of the cooking chamber, the heating medium component in the first direction blown off from the blowoff opening of the heating medium supply section is blown off toward the first surface of the heating object, while the heating medium component in the second direction blown off in a direction different from that of the heating medium component in the first direction is blown off toward the second surface of the heating object which is a back side of the first surface. As a result, the heating medium can effectively be supplied to the first surface of the heating object within the cooking chamber as well as its rear-side second surface, so that a cooking free from heating nonuniformities can be achieved. Therefore, the heating medium can effectively be supplied to the cooking chamber with a simple construction, and moreover the parts count can be reduced, allowing the assembly to be facilitated and the manufacturing cost to be reduced.

In one embodiment of the invention, the heating cooker further comprises a circulation part for sucking the heating medium, which has been blown off from a blowoff opening in the heating medium supply section, from an intake opening provided in the cooking chamber and thereafter returning the heating medium to the heating medium supply section again, wherein the blowoff opening and the intake opening are provided in different inner surfaces, respectively, out of inner surfaces of the cooking chamber.

According to the heating cooker of this embodiment, the heating medium blown off from the blowoff opening of the heating medium supply section is sucked from within the cooking chamber via the intake opening, and thereafter returned to the heating medium supply section again, by the circulation part of the cooking chamber. Therefore, heat recovery can be implemented by the heating medium supply section, allowing the thermal efficiency to be improved.

In one embodiment of the invention, the first surface of the heating object is a surface confronting the inner wall surface side of the cooking chamber on which the heating medium supply section is placed, the heating medium component in the first direction is blown directly against the first surface of the heating object, and the heating medium component in the second direction is once blown against an inner wall surface of the cooking chamber adjacent to the inner wall surface side on which the heating medium supply section is placed, so that the heating medium component is led to the second surface side of the heating object.

According to the heating cooker of this embodiment, the heating medium component in the first direction is blown directly to the first surface of the heating object, while the heating medium component in the second direction is once blown off against the inner wall surface of the cooking chamber adjacent to the inner wall surface on which the heating medium supply section is placed, and then the heating medium component in the second direction is led to the second surface side of the heating object. Therefore, the heating medium blown off from the heating medium supply section can efficiently be supplied to the rear-side second surface of the heating object.

In one embodiment of the invention, a heating medium guiding-and-introducing section for efficiently leading the heating medium to the second surface side of the heating object is provide in an inner wall surface which is adjacent to the blowoff opening and against which the heating medium component in the second direction is once blown.

According to the heating cooker of this embodiment, by the heating medium guiding-and-introducing section provided in the inner wall surface which is adjacent to the blowoff opening and against which the heating medium component in the second direction is once blown, the heating medium can efficiently be led to the second surface side of the heating object.

In one embodiment of the invention, the blowoff opening of the heating medium supply section is provided in a flat surface part of the cooking chamber generally parallel to a ceiling surface of the cooking chamber and a slope part of the cooking chamber adjacent to the flat surface part.

According to the heating cooker of this embodiment, the heating medium component in the first direction can easily be blown off against the first surface side of the heating object from the blowoff opening provided in the flat surface part of the cooking chamber generally parallel to its ceiling surface, while the heating medium in the second direction can easily be blown off toward the side wall surface of the cooking chamber from the blowoff opening of the slope part adjacent to the flat surface part.

In one embodiment of the invention, the heating medium supply section and a blowoff opening thereof are placed on the ceiling side of the cooking chamber.

According to the heating cooker of this embodiment, by the placement of the heating medium supply section and its blowoff opening on the ceiling side of the cooking chamber, the superheated steam is supplied immediately from the heating medium supply section via the blowoff opening into the cooking chamber without any temperature fall in the passages from the heating medium supply section to the cooking chamber. Thus, the heat loss can be reduced.

In one embodiment of the invention, the circulation part has a blower part for forcedly blowing air, and air forcedly blown to the heating medium supply section by the circulation part is heated again by the heating medium supply section, and thereafter blown against the heating object in the cooking chamber.

According to the heating cooker of this embodiment, by the blower part of the circulation part, air is forcedly blown to the heating medium supply section, and the heating medium re-heated by the heating medium supply section is blown off against the heating object in the cooking chamber. Therefore, the heating medium can be supplied powerfully to the heating object.

In one embodiment of the invention, the heating medium contains superheated steam higher than 100° C.

According to the heating cooker of this embodiment, the heating object is heated also by releasing latent heat upon condensation on the surfaces of the heating object, which is implemented by supplying the heating medium containing steam of a 100° C. or higher superheated state to the heating object. As a result of this, a high amount of heat of the superheated steam can reliably and promptly be imparted uniformly to all over the surfaces of the heating object. Thus, a heating cooking of a good finish without nonuniformities can be achieved.

In one embodiment of the invention, the heating medium is hot air obtained by heating air.

According to the heating cooker of this embodiment, recipes for oven cooking of conventional use may be adopted.

There is also provided a heating cooker for heating a heating object, which is accommodated in a cooking chamber and to be heated, by a heating medium obtained by a heating medium supply section, the heating cooker comprising:

a support part for supporting the heating object within the cooking chamber so that the heating object is spaced from a bottom face of the cooking chamber, and a blowoff opening of the heating medium supply section provided in a single inner wall surface out of inner wall surfaces of the cooking chamber, wherein the blowoff opening blows off the heating medium in different directions so as to divide the heating medium into at least a heating medium component in a first direction and a heating medium component in a second direction, the heating medium component in the first direction is blown off toward a first surface of the heating object, and the heating medium component in the second direction is blown off toward a second surface of the heating object which is a back side of the first surface.

According to the heating cooker constructed as described above, for heating of a heating object which is accommodated in the cooking chamber by the support part so as to be spaced from the bottom face of the cooking chamber, the heating medium component in the first direction blown off from the blowoff opening of the heating medium supply section is blown off toward the first surface of the heating object, while the heating medium component in the second direction blown off in a direction different from that of the heating medium component in the first direction is blown off toward the second surface of the heating object which is a back side of the first surface. As a result, the heating medium can effectively be supplied to the first surface of the heating object within the cooking chamber as well as its rear-side second surface, so that a cooking free from heating nonuniformities can be achieved. Therefore, the heating medium can effectively be supplied to the cooking chamber with a simple construction, and moreover the parts count can be reduced, allowing the assembly to be facilitated and the manufacturing cost to be reduced.

In one embodiment of the invention, the first surface of the heating object is a surface confronting the inner wall surface of the cooking chamber on which the heating medium supply section is placed, the blowoff opening of the heating medium supply section has such a configuration that the heating medium component in the first direction is blown off directly to the first surface of the heating object and moreover that the heating medium component in the second direction is once blown off against an inner wall surface of the cooking chamber adjacent to the inner wall surface on which the heating medium supply section is placed, and a heating medium guiding-and-introducing section is further provided so that the heating medium component in the second direction, which has been once blown against the inner wall surface of the cooking chamber adjacent to the inner wall surface on which the heating medium supply section is placed, is led to the second surface side of the heating object.

According to the heating cooker of this embodiment, from the blowoff opening of the heating medium supply section, the heating medium component in the first direction is blown directly to the first surface of the heating object, while the heating medium component in the second direction is once blown off against the inner wall surface of the cooking chamber adjacent to the inner wall surface on which the heating medium supply section is placed. Then, by the heating medium guiding-and-introducing section, the heating medium component in the second direction that has once been blown against the adjacent inner wall surface is led to the second surface side of the heating object. Therefore, the heating medium blown off from the heating medium supply section can efficiently be supplied to the rear-side second surface of the heating object.

As apparent from the above description, according to the heating cooker of the invention, there can be realized a heating cooker in which the heating medium can effectively be supplied to the cooking chamber with a simple construction, and which is capable of facilitating the assembly and reducing the manufacturing cost by reducing the parts count.

DETAILED DESCRIPTION OF THE INVENTION

Hereinbelow, the heating cooker of the present invention will be described in detail by embodiments thereof illustrated in the accompanying drawings.

First Embodiment

Figure 1:
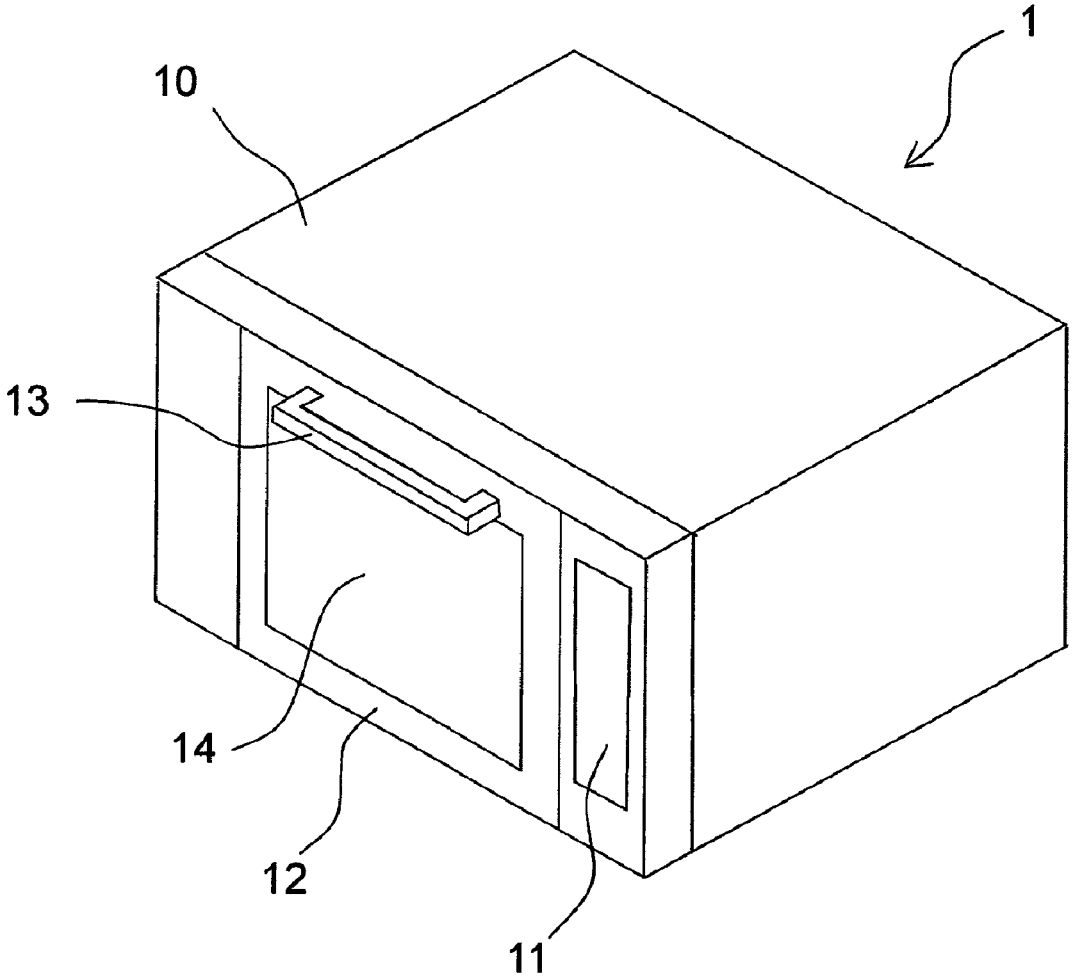
FIG. 1 is an appearance perspective view of a heating cooker according to a first embodiment of the present invention.

FIG. 1 shows an appearance perspective view of the heating cooker according to the first embodiment of the invention. This heating cooker has a door 12 which is provided on the front of a rectangular parallelopiped-shaped body casing 10 and which turns generally about a lower end-side edge. An operation panel 11 is provided on the right side of the door 12, a handle 13 is provided at an upper portion of the door 12, and a window 14 made of heat-resistant glass is provided in a generally center of the door 12.

Figure 2:
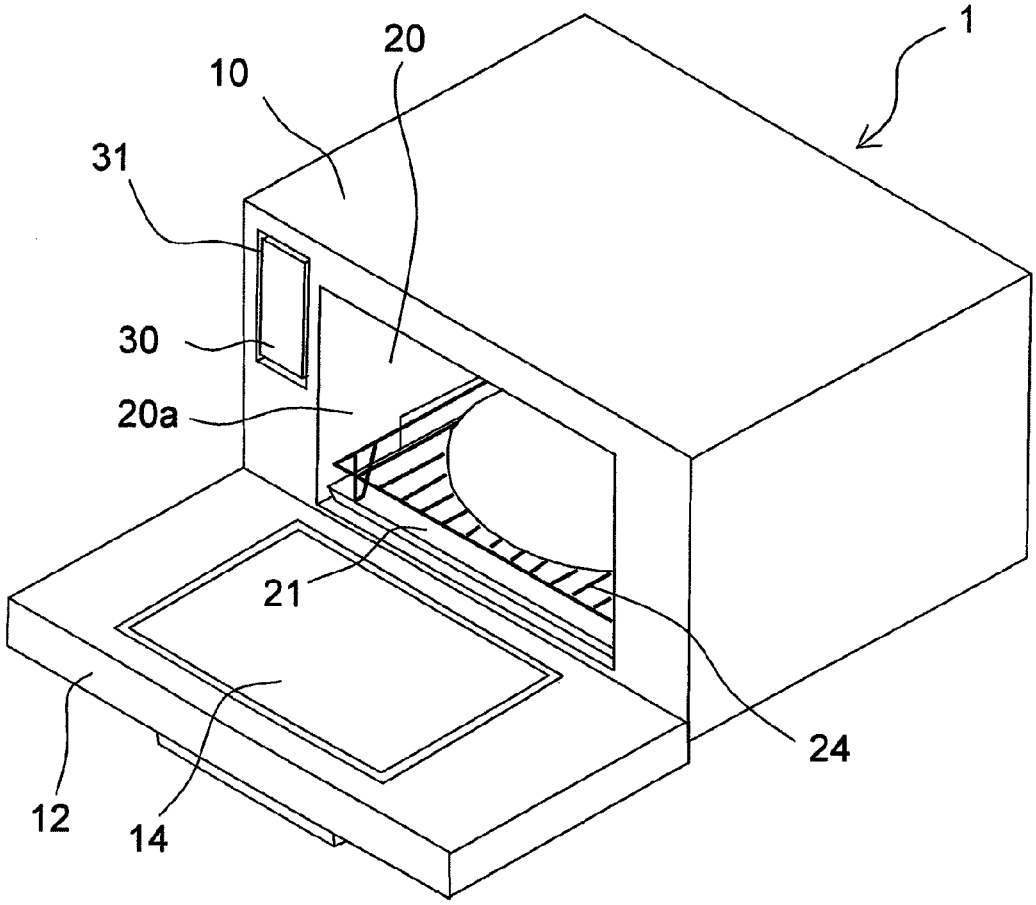
FIG. 2 is an appearance perspective view of the heating cooker shown in FIG. 1 with its door opened.

FIG. 2 shows an appearance perspective view of the heating cooker 1 with its door 12 opened, in which a rectangular parallelopiped-shaped cooking chamber 20 is provided within the body casing 10. The cooking chamber 20 has an opening 20*a* on the front side facing the door 12, and has side faces, a bottom face and a top face all of which are formed from stainless steel plate. Further, one side of the door 12 facing the cooking chamber 20 is formed from stainless steel plate. A heat insulating material (not shown) is set around the cooking chamber 20 and inside the door 12 to provide heat insulation between inside and outside of the cooking chamber 20.

A stainless tray 21 is placed on the bottom face of the cooking chamber 20, and a rack 24 made of stainless steel wire as an example of a support portion for mounting a heating object, which is to be heated, is placed on the tray 21. It is noted that with the door 12 opened, the upper face of the door 12 becomes generally horizontal, so that the heating object, when taken out, can be temporarily rested on the upper face of the door 12.

Further, on the left side of the cooking chamber 20 of the body casing 10 is provided a water tank accommodating section for accommodating therein a closed type water tank 30. The water tank 30 is to be inserted into a water tank accommodating section 31 along a direction from front face toward rear face side.

Figure 3:
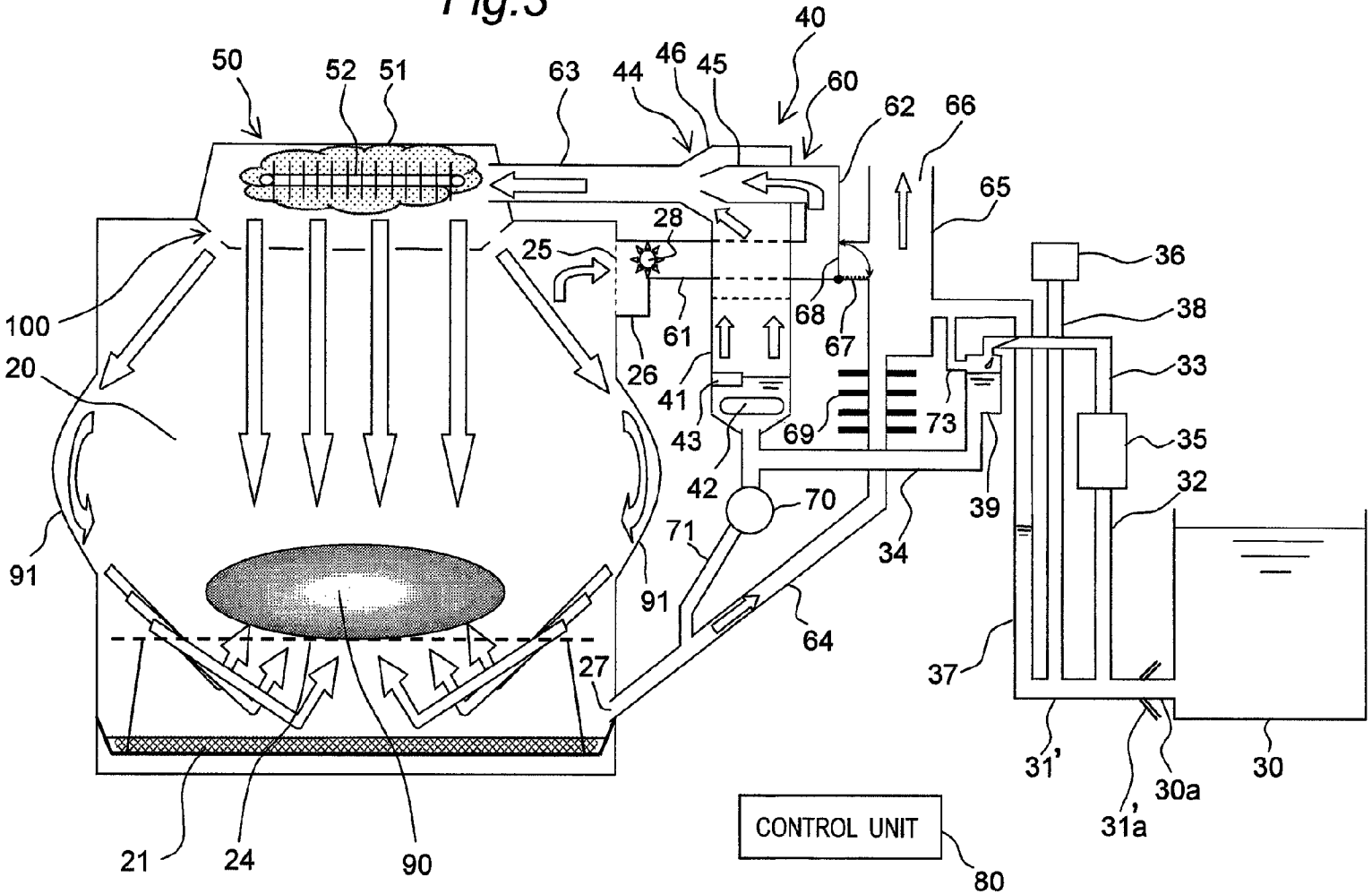
FIG. 3 is a schematic constructional view of the heating cooker shown in FIG. 1.

FIG. 3 is a schematic constructional view showing a basic construction of the heating cooker 1. As shown in FIG. 3, the heating cooker 1 includes a cooking chamber 20, a water tank 30 for storing therein water for use as steam, a steam generator 40 as an example of a steam generation section for vaporizing water fed from the water tank 30 to generate steam, a steam temperature-raising device 50 as an example of a heating medium supply section for heating steam derived from the steam generator 40, and a control unit 80 for controlling operations of the steam generator 40, the steam temperature-raising device 50 and the like. A grating rack 24 is placed on the tray 21 set within the cooking chamber 20, and a heating object 90 is to be placed at a generally center of the rack 24. Then, the heating object 90 is accommodated in the cooking chamber 20 so as to be spaced from the bottom face of the cooking chamber 20.

Further, a connecting portion 30*a* provided on the lower side of the water tank 30 is connectable to a funnel-like reception port 31'*a* provided at one end of a first water supply pipe 31'. A suction side of a pump 35 is connected to an end portion of a second water supply pipe 32 branched from the first water supply pipe 31' and extending upward, while one end of a third water supply pipe 33 is connected to a discharge side of the pump 35. Also, at an upper end of a water level sensor pipe 38 branched from the first water supply pipe 31' and extending upward is provided a water-tank water level sensor 36. Moreover, a later-described exhaust gas duct 65 is connected to an upper end of an air releasing pipe 37 branched from the first water supply pipe 31' and extending upward.

The third water supply pipe 33 is L-shaped so as to be generally horizontally bent from its vertical portion, while an auxiliary tank 39 is connected to the other end of the third water supply pipe 33. One end of a fourth water supply pipe 34 is connected to a lower end of the auxiliary tank 39, while a lower end of the steam generator 40 is connected to the other end of the fourth water supply pipe 34. Further, one end of a drain valve 70 is connected to a portion of the steam generator 40 lower than a connecting point of the fourth water supply pipe 34. Then, one end of a drain pipe 71 is connected to the other end of the drain valve 70, while the other end of the drain pipe 71 is connected to an upstream side of a discharge opening 27 of a discharge passage 64. It is noted that an upper portion of the auxiliary tank 39 is communicated with the atmospheric air via an air releasing pipe 73 and an exhaust gas duct 65.

The steam generator 40 includes a pot 41 having a lower portion to which the other end of the fourth water supply pipe 34 is connected, a steam generation heater 42 placed near the bottom face in the pot 41, a water level sensor 43 placed near the upper side of the steam generation heater 42 in the pot 41, and a steam suction ejector 44 fitted on an upper side of the pot 41. A fan casing 26 is placed outside an intake opening 25 provided in the upper side surface of the heating chamber 20. Steam in the heating chamber 20 is sucked through the intake opening 25 by a blower fan 28 serving as an example of a blower part set in the fan casing 26, and then fed toward an inlet side of the steam suction ejector 44 of the steam generator 40 via a first pipe 61 and a second pipe 62. The first pipe 61 is positioned generally horizontal and has one end connected to the fan casing 26. The second pipe 62, which is positioned generally vertically, has one end connected to the other end of the first pipe 61 and the other end connected to an inlet side of an inner nozzle 45 of the steam suction ejector 44.

The steam suction ejector 44 has an outer nozzle 46 which covers the outside of the inner nozzle 45, and a discharge side of the inner nozzle 45 is communicated with the internal space of the pot 41. One end of a third pipe 63 is connected to a discharge side of the outer nozzle 46 of the steam suction ejector 44, while the other end of the third pipe 63 is connected to a steam temperature-raising device 50.

The fan casing 26, the first pipe 61, the second pipe 62, the steam suction ejector 44, the third pipe 63 and the steam temperature-raising device 50 constitute an external circulation passage 60 as an example of a circulation part. Moreover, one end of a discharge passage 64 is connected to a discharge opening 27 provided on the lower side face of the heating chamber 20, while the other end of the discharge passage 64 is connected to one end of the exhaust gas duct 65. Further, an exhaust port 66 is provided at the other end of the exhaust gas duct 65. A radiator 69 is externally fitted on the exhaust gas duct 65 side of the discharge passage 64. The exhaust gas duct 65 is connected via an exhaust gas passage 67 to a joint portion of the first pipe 61 and the second pipe 62, which form the external circulation passage 60. Further, a damper 68 which opens and closes the exhaust gas passage 67 is placed on the joint side of the first and second pipes 61 and 62 in the exhaust gas passage 67.

Moreover, the steam temperature-raising device 50 includes a dish-shaped casing 51 placed at a ceiling-side generally center of the heating chamber 20 with its opening facing down, and a steam superheater 52 placed in the dish-shaped casing 51. The bottom face of the dish-shaped casing 51 is formed with a metallic protruding portion 100 provided in the ceiling surface of the heating chamber 20.

Figure 4:
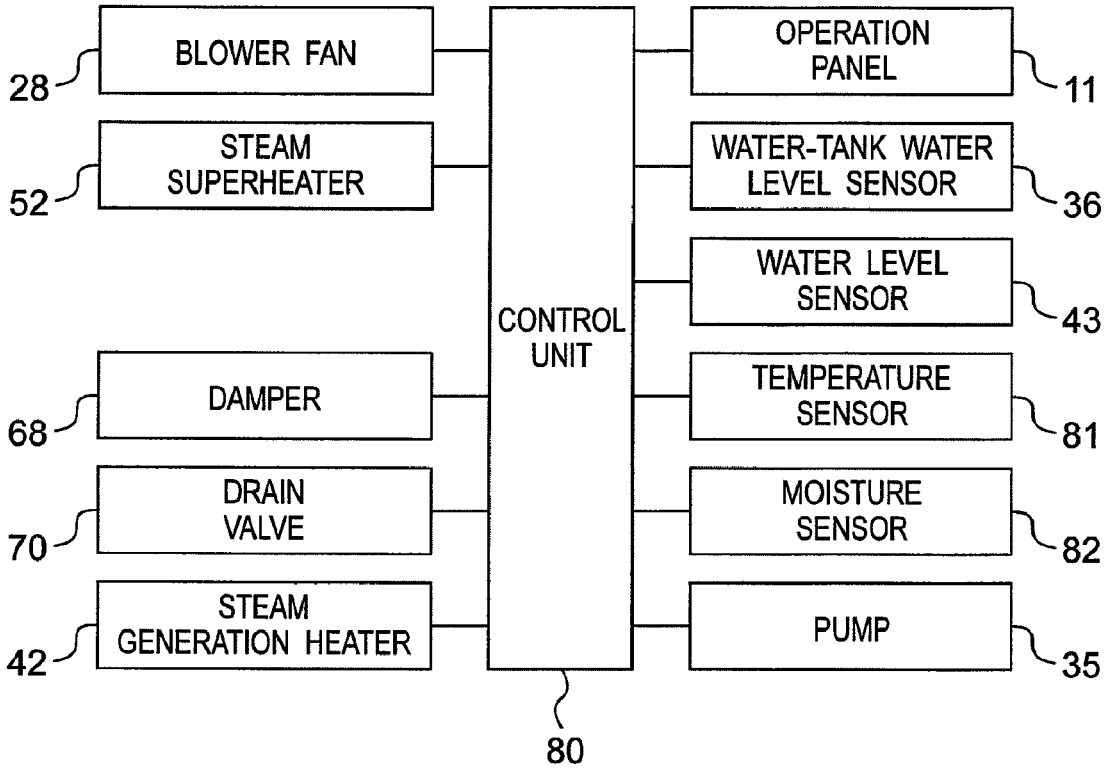
FIG. 4 is a control block diagram of the heating cooker shown in FIG. 1.

Next, a control block of the heating cooker 1 shown in FIG. 4 is described below.

As shown in FIG. 4, connected to a control unit 80 are a blower fan 28, a steam superheater 52, a damper 68, a drain valve 70, a steam generation heater 42, an operation panel 11, a water-tank water level sensor 36, a water level sensor 43, a temperature sensor 81 for detecting the temperature in the heating chamber 20 (shown in FIG. 3), a moisture sensor 82 for detecting the humidity in the heating chamber 20 and a pump 35.

The control unit 80, which is composed of a microcomputer, input/output circuits and the like, controls the blower fan 28, the steam superheater 52, the damper 68, the drain valve 70, the steam generation heater 42, the operation panel 11 and the pump 35 in accordance with a specified program, based on detection signals from the water-tank water level sensor 36, the water level sensor 43, the temperature sensor 81 and the moisture sensor 82.

In the heating cooker 1 having the above structure, upon pressing of an electric power switch (not shown) in the operation panel 11 to turn on the power supply, operation of heating cooking is started by operation with the operation panel 11. Then, first, the control unit 80 closes the drain valve 70 and, with the exhaust gas passage 67 closed by the damper 68, starts operation of the pump 35. Water is then supplied by the pump 35 from the water tank 30 into the pot 41 of the steam generator 40 via the first to the fourth water supply pipes 31 to 34. Then, when the water level sensor 43 detects that the water level in the pot 41 has reached a specified water level, the pump 35 is stopped to stop water supply.

Next, the steam generation heater 42 is turned on, so that a predetermined amount of water accumulated in the pot 41 is heated by the steam generation heater 42.

Then, in concurrence with the turn-on of the steam generation heater 42, or once the temperature of the water in the pot 41 has reached a specified temperature, the blower fan 28 is turned on, and the steam superheater 52 of the steam temperature-raising device 50 is turned on. As a consequence, the blower fan 28 sucks air (including steam) in the heating chamber 20 through the intake opening 25, and sends the air (including steam) to the circulation passage 60. The blower fan 28, for which a centrifugal fan is used, is enabled to generate higher pressure than a propeller fan. Besides, rotating the centrifugal fan used for the blower fan 28 at high speed with a DC motor allows the flow velocity of the circulating air flow to be greatly increased.

Next, once the water in the pot 41 of the steam generator 40 boils, saturated steam is generated, and the generated saturated steam joins the circulating air flow passing along the circulation passage 60 at the place of the steam suction ejector 44. The steam coming from the steam suction ejector 44 flows into the steam temperature-raising device 50 via the third pipe 63 at high speed.

Figure 5:
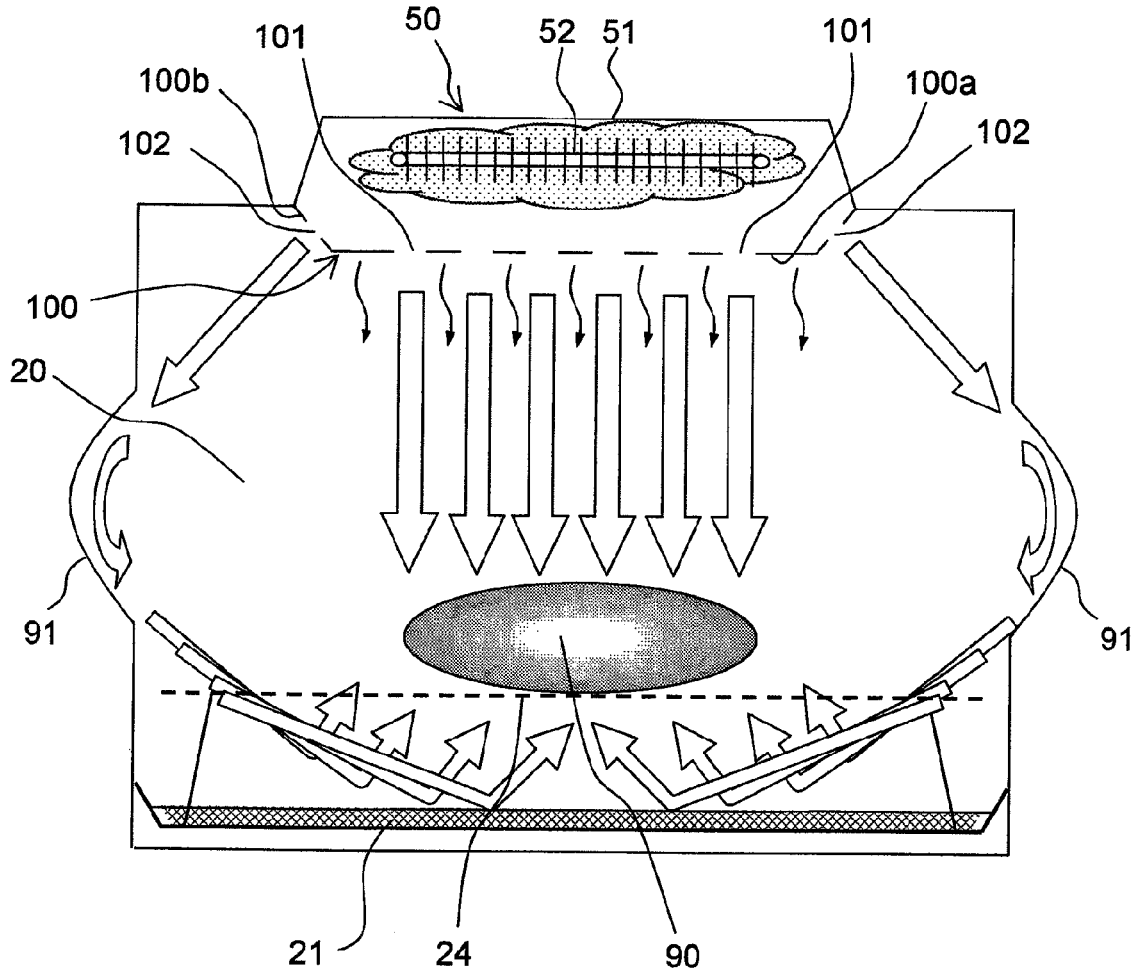
FIG. 5 is a schematic view of a cooking chamber of the heating cooker as viewed from the front.

FIG. 5 shows a schematic view of the cooking chamber 20 as viewed from the front, where a protruding portion 100 having a sloped surface 100*b* that slopes against the ceiling surface is provided on the ceiling side of the cooking chamber 20. A plurality of first ceiling steam blowoff openings 101 facing the bottom face of the cooking chamber 20 are provided in a flat surface 100*a* of the protruding portion 100, while a plurality of second ceiling steam blowoff openings 102 facing side faces of the cooking chamber 20 are provided in the sloped surface 100*b* of the protruding portion 100. Although the protruding portion 100 is formed into a trapezoidal cross section in this first embodiment, the shape of the protruding portion is not limited to this. Also, the sloped surface 100*b* of the protruding portion 100 having the second ceiling steam blowoff openings 102 is provided only on the left-and-right side face sides of the cooking chamber 20, but may also be provided on the front-and-rear face sides of the cooking chamber 20, or in combinations of those. The first ceiling steam blowoff openings 101 are an example of blowoff openings through which a heating medium component in a first direction from the steam temperature-raising device 50 blows off toward a first surface of the heating object 90, while the second ceiling steam blowoff openings 102 are an example of blowoff openings through which a heating medium component in a second direction from the steam temperature-raising device 50 blows off toward a second surface of the heating object 90.

Then, the steam that has flowed from the steam generator 40 into the steam temperature-raising device 50 is heated by the steam superheater 52 so as to become superheated steam of about 300° C. (variable depending on contents of the cooking). A part of the superheated steam jets out toward lower part of the cooking chamber 20 through the plurality of first ceiling steam blowoff openings 101 provided in the protruding portion 100. Also, another part of the superheated steam jets out through the second ceiling steam blowoff openings 102 provided in the sloped surface 100*b* of the protruding portion 100 and is guided by heating medium guiding-and-introducing sections 91 provided in the left-and-right side faces of the cooking chamber 20, so that superheated steam is supplied to the heating object 90 in the cooking chamber 20 from its lower surface side.

Thus, superheated steam jetted out through the first ceiling steam blowoff openings 101 on the ceiling side of the cooking chamber 20 is supplied toward the centrally positioned heating object 90, while superheated steam jetted out toward the side face sides through the left-and-right second ceiling steam blowoff openings 102 of the cooking chamber 20 is efficiently supplied to the rear surface side of the heating object 90. The steam within the cooking chamber 20 is sucked into the intake opening 25 in succession, passes through the circulation passage 60 and returns to the cooking chamber 20, and this circulation is repeated.

By forming the flow of superheated steam in the cooking chamber 20 in this way, superheated steam from the steam temperature-raising device 50 can be jetted out through the first ceiling steam blowoff openings 101 and the second ceiling steam blowoff openings 102 while temperature and humidity distribution in the cooking chamber 20 are kept uniform, so that the superheated steam can be made to efficiently collide with upper and lower surface sides of the heating object 90 rested on the rack 24. Then, the heating object 90 is heated by the collisions of the superheated steam. In this process, the superheated steam coming into contact with surfaces of the heating object 90 heats the heating object 90 also by releasing latent heat upon condensation on the surfaces of the heating object 90. As a result of this, a high amount of heat of the superheated steam can reliably and promptly be imparted uniformly to all over the surfaces of the heating object 90. Further, the heating object 90 is heated even also by radiant heat radiated mainly from the flat surface 100*a* of the protruding portion 100. Consequently, a heating cooking of a good finish without nonuniformities can be achieved.

In addition, in this first embodiment, a cooking sequence in which steam is not generated by the steam generator 40 may also be provided. In this case, air in the cooking chamber 20 shown in FIG. 3 is sucked through the intake opening 25 by the blower fan 28 and then fed into the steam temperature-raising device 50 again, so that hot air or steam-containing hot air is jetted out as a heating medium from the first ceiling steam blowoff openings 101 and the second ceiling steam blowoff openings 102.

In the operation of the heating cooking, as time elapses, the amount of steam in the cooking chamber 20 increases and excess-quantity steam is released from the discharge opening 27 via the discharge passage 64 and the exhaust gas duct 65 out of the exhaust port 66. In this case, steam passing through the discharge passage 64 is cooled and condensed by the radiator 69 provided on the discharge passage 64, thus preventing the steam from being released outside as it is. Water condensed by the radiator 69 within the discharge passage 64 flows down in the discharge passage 64 so as to be led to the tray 21, and disposed of together with water generated through the cooking after completion of the cooking.

Upon the completion of the cooking, a message indicating termination of cooking is displayed on the operation panel 11 by the control unit 80, and also a signal is sounded with a buzzer (not shown) provided on the operation panel 11. When the user, who has been thereby notified of the termination of cooking, opens the door 12, the control unit 80 detects the opening of the door 12 with a sensor (not shown), and instantaneously opens the damper 68 of the exhaust gas passage 67. As a result, the first pipe 61 of the circulation passage 60 comes to be communicated with the exhaust gas duct 65 via the exhaust gas passage 67, so that the steam in the heating chamber 20 is discharged by the blower fan 28 through the exhaust port 66 via the intake opening 25, the first pipe 61, the exhaust gas passage 67 and the exhaust duct 65. This damper operation functions in the same manner when the user opens the door 12 during cooking. Therefore, the user is allowed to safely take out the heating object 90 from the heating chamber 20 without being exposed to steam.

According to the heating cooker constituted as described above, when the heating object is heated by superheated steam supplied from the steam temperature-raising device 50 via the plurality of first ceiling steam blowoff openings 101 provided on the ceiling side of the cooking chamber 20, part of the superheated steam derived from the steam temperature-raising device 50 is blown off toward the side face side of the cooking chamber 20 via the plurality of second ceiling steam blowoff openings 102 provided on the ceiling side of the cooking chamber 20. As a result, the superheated steam blown off from the plurality of second ceiling steam blowoff openings 102 is guided by the heating medium guiding-and-introducing sections 91 provided on the left-and-right side faces of the cooking chamber 20, so that the superheated steam is supplied sideways to the heating object 90 within the cooking chamber 20. Consequently, the superheated steam can effectively be supplied to the heating object 90 in the cooking chamber 20 from upward and sideward, making it possible to achieve a cooking free from heating nonuniformities. Accordingly, superheated steam can effectively be supplied to the cooking chamber 20 with a simple construction, and moreover the parts count can be reduced, allowing the assembly to be facilitated and the manufacturing cost to be reduced.

Furthermore, by the external circulation passage 60 of the cooking chamber 20, superheated steam blown off from the plurality of first ceiling steam blowoff openings 101 and the plurality of second ceiling steam blowoff openings 102 of the steam temperature-raising device 50 is sucked from the cooking chamber 20 through the intake opening 25, and thereafter returned to the steam temperature-raising device 50 again. Thus, the superheated steam can be thermally collected by the steam temperature-raising device 50, allowing the thermal efficiency to be improved.

Also, part of the superheated steam (heating medium component in the first direction) derived from the plurality of first ceiling steam blowoff openings 101 is blown off directly to a first surface, which is the upper surface of the heating object 90, while part of the superheated steam (heating medium component in the second direction) derived from the plurality of second ceiling steam blowoff openings 102 is once blown off to side wall surfaces of the cooking chamber 20 adjacent to the ceiling surface side on which the steam temperature-raising device 50 is placed, and then led toward a second surface, which is the rear surface of the heating object 90. Thus, the superheated steam blown off from the steam temperature-raising device 50 is efficiently supplied to the second surface side of the heating object 90, which is the rear surface side.

Also, by the heating medium guiding-and-introducing sections 91, which is provided on the side wall surfaces adjacent to the plurality of second ceiling steam blowoff openings 102 and to which the heating medium component in the second direction is once blown off, the superheated steam can efficiently be led to the second surface side of the heating object 90.

Also, since the plurality of second ceiling steam blowoff openings 102 are provided in the sloped surface 100*b* of the protruding portion 100 provided on the ceiling side of the cooking chamber 20 and sloped against the ceiling surface of the cooking chamber 20, part of the superheated steam derived from the steam temperature-raising device 50 can easily be directed toward the side face sides of the cooking chamber 20.

Also, by the arrangement that the steam temperature-raising device 50 and the plurality of first ceiling steam blowoff openings 101 as well as the plurality of second ceiling steam blowoff openings 102 are placed on the ceiling side of the cooking chamber 20, the superheated steam is supplied immediately from the steam temperature-raising device 50 into the plurality of first ceiling steam blowoff openings 101 and the plurality of second ceiling steam blowoff openings 102 without any temperature fall in the passages from the steam temperature-raising device 50 to the cooking chamber 20. Thus, the heat loss can be reduced.

Also, the superheated steam from the steam temperature-raising device 50 is supplied toward the bottom-face side lower part of the cooking chamber 20 via the plurality of first ceiling steam blowoff openings 101 facing the bottom face side of the cooking chamber 20, while the superheated steam from the steam temperature-raising device 50 is supplied toward the side face side of the cooking chamber 20 via the plurality of second ceiling steam blowoff openings 102 facing the side face side of the cooking chamber 20. Thus, the superheated steam can effectively be supplied to the heating object 90 within the cooking chamber 20 so as to prevent heating nonuniformities.

Also, superheated steam generated by the steam generator 40 is supplied to the steam temperature-raising device 50, while superheated steam containing steam is supplied from the steam temperature-raising device 50 to the heating object placed within the cooking chamber 20. Therefore, a cooking of a good finish using superheated steam becomes achievable.

Second Embodiment

Figure 6:
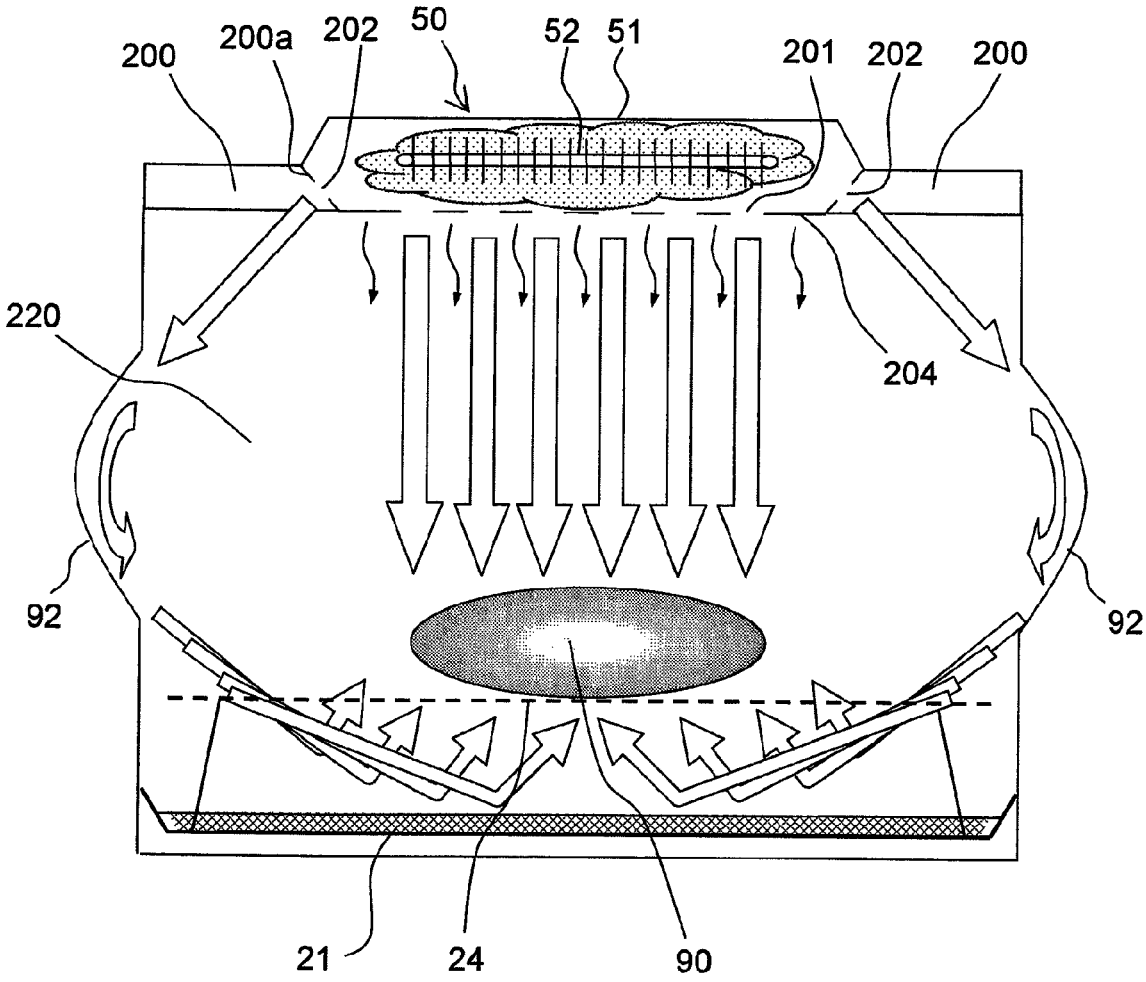
FIG. 6 is a schematic view of the cooking chamber of a heating cooker according to a second embodiment of the invention as viewed from the front.

FIG. 6 shows a schematic view of a cooking chamber of a heating cooker according to a second embodiment of the invention as viewed from the front. The heating cooker of this second embodiment is similar in construction to the heating cooker of the first embodiment except the protruding portion of the cooking chamber. Therefore, like component members are designated by like reference numerals, with their description omitted, and FIGS. 1 to 3 are referenced therefor also in this embodiment.

As shown in FIG. 6, a recessed portion 200 having a sloped surface 200*a* that is sloped against the ceiling surface is provided on the ceiling side of the cooking chamber 220. A plurality of first ceiling steam blowoff openings 201 facing the bottom face side of the cooking chamber 220 are provided in the ceiling surface 204, while a plurality of second ceiling steam blowoff openings 202 facing the side face side of the cooking chamber 220 are provided in the sloped surface 200*a* of the recessed portion 200. Although the recessed portion 200 is formed into a trapezoidal cross section in this second embodiment, the shape of the recessed portion is not limited to this. Also, the sloped surface 200*a* of the recessed portion 200 having the second ceiling steam blowoff openings 202 is provided only on the left-and-right side face sides of the cooking chamber 220, but may also be provided on the front-and-rear face sides of the cooking chamber 220, or in combinations of those. The first ceiling steam blowoff openings 201 are an example of blowoff openings through which a heating medium component in a first direction from the steam temperature-raising device 50 as an example of a heating medium supply section blows off toward a first surface of the heating object 90, while the second ceiling steam blowoff openings 202 are an example of blowoff openings through which a heating medium component in a second direction from the steam temperature-raising device 50 blows off toward a second surface of the heating object 90.

Then, the steam that has flowed from the steam generator 40 into the steam temperature-raising device 50 is heated by the steam superheater 52 so as to become superheated steam of about 300° C. (variable depending on contents of the cooking). A part of the superheated steam jets out toward lower part of the cooking chamber 220 through the plurality of first ceiling steam blowoff openings 201 provided in the ceiling surface 204. Also, another part of the superheated steam jets out through the second ceiling steam blowoff openings 102 provided in the sloped surface 200*a* of the recessed portion 200 and is guided by heating medium guiding-and-introducing sections 92 provided in the left-and-right side faces of the cooking chamber 220, so that superheated steam is supplied to the heating object 90 in the cooking chamber 220 from its lower surface side.

Thus, superheated steam jetted out through the first ceiling steam blowoff openings 201 on the ceiling side of the cooking chamber 220 is supplied powerfully toward the centrally positioned heating object 90, while superheated steam jetted out toward the side face sides through the left-and-right second ceiling steam blowoff openings 202 of the cooking chamber 220 is efficiently supplied to the rear surface side of the heating object 90. The steam within the cooking chamber 220 is sucked into the intake opening 25 in succession, passes through the circulation passage 60 and returns to the cooking chamber 220, and this circulation is repeated.

By forming the convection of superheated steam in the cooking chamber 220 in this way, superheated steam from the steam temperature-raising device 50 can be jetted out through the first ceiling steam blowoff openings 201 and the second ceiling steam blowoff openings 202 while temperature and humidity distribution in the cooking chamber 220 are kept uniform, so that the superheated steam can be made to efficiently collide with the heating object 90 rested on the rack 24. As a result of this, a high amount of heat of the superheated steam can reliably and promptly be imparted uniformly to all over the surfaces of the heating object 90. Consequently, a heating cooking of a good finish without nonuniformities can be achieved.

The heating cooker of the second embodiment has the same effects as those of the heating cooker of the first embodiment.

Third Embodiment

Figure 7:
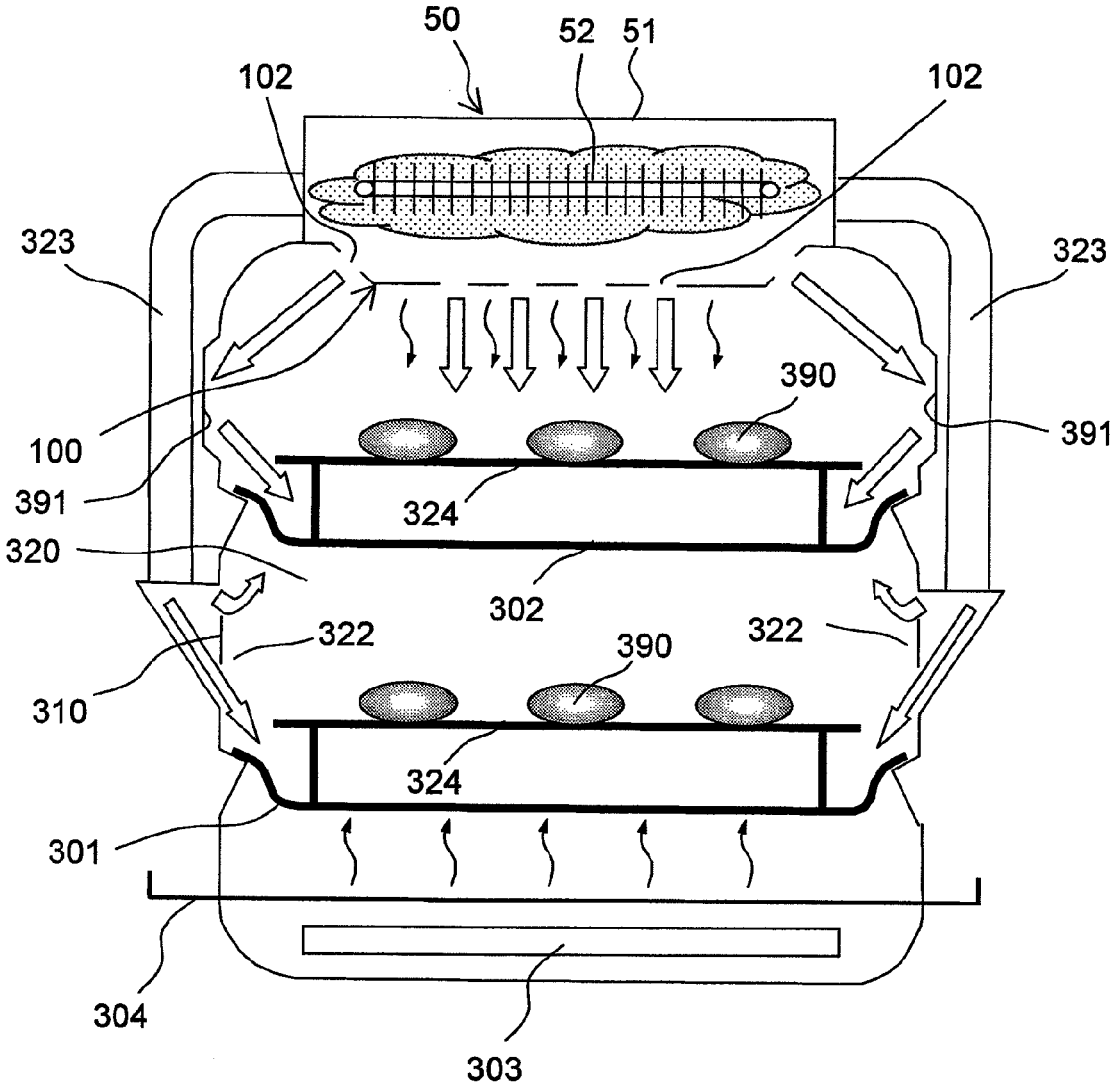
FIG. 7 is a schematic view of the cooking chamber of a heating cooker according to a third embodiment of the invention as viewed from the front.

FIG. 7 shows a schematic view of a cooking chamber of a heating cooker according to a third embodiment of the invention as viewed from the front. The heating cooker of this third embodiment is similar in construction to the heating cooker of the first embodiment except a upper-and-lower two-stage tray structure and a side-face blowoff structure. Therefore, like component members are designated by like reference numerals, with their description omitted, and FIGS. 1 to 3 are referenced therefor also in this embodiment.

As shown in FIG. 7, the heating cooker of this third embodiment includes two trays 301, 302 placed on lower stage and upper stage, respectively, in a cooking chamber 320. Also, side-face steam blowoff openings 322 as an example of side-face heating medium blowoff openings each formed into a generally rectangular shape which is generally horizontal in its longitudinal direction are provided in left-and-right side faces within the cooking chamber 320. The steam temperature-raising device 50 as an example of the heating medium supply section has connections with one end of each of steam supply passages 323 extending on left-and-right two sides of the cooking chamber 320. The other ends of the steam supply passages 323 extend downward along the two side faces of the cooking chamber 320 so as to be connected to the side-face steam blowoff openings 322, respectively, provided in the lower-side two side faces of the cooking chamber 320.

Also, a lower heater 303 is placed on the bottom face of the cooking chamber 320, and ceramic glass 304 is placed above the lower heater 303. Radiant heat from the lower heater 303 is radiated to the lower-stage tray 301 via the ceramic glass 304.

Part of superheated steam from the steam temperature-raising device 50 is supplied to an upper side of a heating object 390 on a rack 324 rested on the upper-stage tray 302 via a plurality of first ceiling steam blowoff openings 101 provided on the ceiling side of the cooking chamber 320. Meanwhile, part of the superheated steam from the steam temperature-raising device 50 blows off toward the side face sides of the cooking chamber 320 via the plurality of second ceiling steam blowoff openings 102 provided on the ceiling side of the cooking chamber 320. As a result of this, the superheated steam blown off from the plurality of second ceiling steam blowoff openings 102 is guided by heating medium guiding-and-introducing sections 391 provided on the left-and-right side faces, so that the superheated steam is efficiently supplied to a lower side of the heating object 390 on the rack 324 rested on the upper-stage tray 302.

A partitioning plate 310 made of punching metal is set at a central portion of each of the side-face steam blowoff openings 322 so that the superheated steam blown off from the side-face steam blowoff openings 322 is diverged diagonally downward and diagonally upward. As a result, superheated steam blown off diagonally upward from the side-face steam blowoff openings 322 is supplied to the upper side of the heating object 390 on the rack 324 rested on the lower-stage tray 301, while superheated steam blown off diagonally downward from the side-face steam blowoff openings 322 is supplied to the lower side of the heating object 390 on the rack 324 rested on the lower-stage tray 301.

According to the heating cooker constructed as described above, in a construction that enables two-stage cooking with the heating object 390 rested on the two trays 301, 302 placed on the upper and lower stages within the cooking chamber 320, superheated steam from the steam temperature-raising device 50 is supplied from the side-face steam blowoff openings 322 to the space between the trays 301, 302 via the steam supply passages 323 that connect the steam temperature-raising device 50 and the side-face steam blowoff openings 322 to each other. As a result of this, the superheated steam supplied via the ceiling-side first ceiling steam blowoff openings 101 and second ceiling steam blowoff openings 102 is supplied to the heating object 390 rested on the upper-stage tray 302, while superheated steam supplied via the side-face steam blowoff openings 322 provided in the side faces of the cooking chamber 320 is supplied to the heating object 390 rested on the lower-stage tray 301. Thus, a cooking of a good finish without nonuniformities can be achieved even with an upper-and-lower two-stage tray structure.

The heating cooker of the third embodiment has the same effects as those of the heating cooker of the first embodiment.

The first to third embodiments have been described on a construction that superheated steam obtained from steam generated by the steam generator 40 and superheated by the steam temperature-raising device 50 as an example of the heating medium supply section is supplied into the cooking chamber 20, 220, 320. However, the heating cooker of the invention may also be applied to cases in which steam is not generated by the steam generator 40, but hot air or steam-containing air obtained by sucking air present in the cooking chamber 20, 220, 320 from the intake opening 25 by the blower fan 28 and feeding the air to the steam temperature-raising device 50 again is supplied into the cooking chamber.

The invention claimed is:

1. A heating cooker for heating a heating object, which is rested in a cooking chamber so as to be spaced from a bottom surface of the cooking chamber and to be heated, by a heating medium, wherein the cooking chamber has:

inner surfaces including a ceiling surface, the bottom surface and side surfaces on both sides, a heating medium supply section provided on the ceiling surface and comprising a horizontal part generally parallel to the ceiling surface and slope parts on both sides of the horizontal part, blow-off openings provided in the horizontal part and the slope parts through which the heating medium is blown into the cooking chamber, and heating medium guiding-and-introducing sections provided on the side surfaces of the heating chamber by recessing the side surfaces so as to have a curved surface for smoothly guiding and directionally changing the heating medium, wherein the heating medium is blown off, on one hand, as a first heating medium component from the blow-off opening of the horizontal part directly to a first surface of the heating object confronting the ceiling surface and blown off, on the other hand, as a second heating medium component from the blow-off openings of the slope parts toward the guiding-and-introducing sections of the side surfaces and then reflected on the bottom surface of the heating chamber to reach a second surface of the heating object, which is opposite to the first surface.

2. The heating cooker as claimed in claim 1, comprising a circulation part for sucking the heating medium, which has been blown off from a blowoff opening in the heating medium supply section, from an intake opening provided in the cooking chamber and thereafter returning the heating medium to the heating medium supply section again, wherein the blowoff opening and the intake opening are provided in different inner surfaces, respectively, out of the inner surfaces of the cooking chamber.

3. The heating cooker as claimed in claim 2, wherein the circulation part has a blower part for forcedly blowing air, and air forcedly blown to the heating medium supply section by the circulation part is heated again by the heating medium supply section, and thereafter blown against the heating object in the cooking chamber.

4. The heating cooker as claimed in claim 1, wherein the heating medium contains steam of a 100° C. or higher superheated state.

5. The heating cooker as claimed in claim 1, wherein the heating medium is hot air obtained by heating air.

* * * * *